US008820271B2

(12) United States Patent
Benet

(10) Patent No.: US 8,820,271 B2
(45) Date of Patent: Sep. 2, 2014

(54) METHOD FOR CONTROLLING THE FLOW OF A COOLING LIQUID

(75) Inventor: Frederic Benet, Buc (FR)

(73) Assignee: RENAULT S.A.S., Boulogne-Billancourt (FR)

( * ) Notice: Subject to any disclaimer, the term of this patent is extended or adjusted under 35 U.S.C. 154(b) by 848 days.

(21) Appl. No.: 13/003,652

(22) PCT Filed: Jun. 29, 2009

(86) PCT No.: PCT/FR2009/051251
§ 371 (c)(1), (2), (4) Date: Mar. 31, 2011

(87) PCT Pub. No.: WO2010/004184
PCT Pub. Date: Jan. 14, 2010

(65) Prior Publication Data

US 2011/0178692 A1 Jul. 21, 2011

(30) Foreign Application Priority Data

Jul. 11, 2008 (FR) ..... 08 54757

(51) Int. Cl.
*F01P 7/14* (2006.01)
*F01P 3/02* (2006.01)
*F01P 7/16* (2006.01)

(52) U.S. Cl.
CPC .. *F01P 7/167* (2013.01); *F01P 3/02* (2013.01)
USPC ..... 123/41.05; 701/102

(58) Field of Classification Search
CPC ..... B60W 10/06; F02D 41/18; F01P 7/167; F01P 7/00; F01P 2025/46
USPC ..... 701/102
See application file for complete search history.

(56) References Cited

U.S. PATENT DOCUMENTS

| | | | | |
|---|---|---|---|---|
| 4,977,862 | A * | 12/1990 | Aihara et al. | 123/41.12 |
| 6,142,108 | A * | 11/2000 | Blichmann | 123/41.05 |
| 6,390,081 | B1 | 5/2002 | Novak et al. | |
| 2002/0016656 | A1* | 2/2002 | Chung et al. | 701/36 |
| 2003/0106536 | A1 | 6/2003 | Sass et al. | |
| 2004/0098174 | A1* | 5/2004 | Suda et al. | 700/299 |
| 2006/0288967 | A1 | 12/2006 | Joyce et al. | |

FOREIGN PATENT DOCUMENTS

| | | |
|---|---|---|
| EP | 1 310 642 | 5/2003 |
| GB | 2 425 619 | 11/2006 |
| WO | 99 15769 | 4/1999 |

OTHER PUBLICATIONS

International Search Report issued Feb. 24, 2010 in PCT/FR09/051251 filed Jun. 29, 2009.

* cited by examiner

*Primary Examiner* — Lindsay Low
*Assistant Examiner* — Jacob Amick
(74) *Attorney, Agent, or Firm* — Oblon, Spivak, McClelland, Maier & Neustadt, L.L.P.

(57) ABSTRACT

A method for controlling flow of a cooling liquid in a combustion engine, including a casing and a water pump. A material temperature estimate, corresponding to the hottest point in the casing, is carried out from a stored power calculation calculated by a restored power integral corresponding to power restored to the cooling liquid if the cooling liquid were set in motion.

20 Claims, 3 Drawing Sheets

METHOD FOR CONTROLLING THE FLOW OF A COOLING LIQUID

The invention relates to the field of the control of water pumps in a motor vehicle combustion engine. The invention relates in particular to a method for controlling the rate of flow of liquid coolant circulated by a water pump in a motor vehicle combustion engine.

Such a motor vehicle comprises a water pump which may be mechanical or electric.

The job of a water pump is to convert speed energy into pressure energy. Thanks to the evolutive section of a volute casing in the region of an impeller, the speed of the fluid decreases and the pressure increases.

A mechanical water pump comprises, as illustrated in FIG. 1, a body M8 housed in a crank case M9 of an engine, a shaft M2 on which is mounted coaxially an impeller M1 and a pulley M3, a dynamic seal M4 and rolling bearings M5.

On three sides, the body M8 of the engine delimits a reservoir M6. The last side is delimited by the rolling bearings M5.

The pulley M3, the rolling bearings M5, the seal M4 and finally the impeller M1 are positioned in succession along the shaft M2. The pulley M3, the rolling bearings M5 and part of the seal M4 are arranged in a first part known as the dry side. The impeller M1 and another part of the seal M4 are arranged in a second part which is in contact with the liquid coolant.

The rotation of the pulley M3 is driven by the engine. The rotational movement is transmitted to the impeller M1 via the shaft M2. The rolling bearings M5 allow this rotational movement with a good level of guidance and low wear. The seal M4 provides sealing between the dry side and the part in contact with the liquid coolant. This seal M4 comprises two rings. A first ring is fixed and connected to the body M8. A second ring rotates and is connected to the shaft M2.

In order to limit the temperature of the seal M4, a small leakage flow of liquid coolant through the seal M4 is permitted. This leakage flow is collected in the reservoir M6 where the liquid solidifies upon contact with the air.

In an engine equipped with a mechanical water pump, the liquid coolant is circulated by the engine. Thus, as soon as the engine is turning over, the liquid coolant circulates and cools the engine.

However, in some instances, particularly upon start-up and/or when the ambient temperature is low, it is desirable for the water pump to be deactivated. Specifically, as long as the engine temperature does not exceed a given critical temperature beyond which there is a risk of abnormal engine operation, there is no need to cool it.

Also, the higher the engine temperature, the lower the oil viscosity, thus reducing friction and therefore engine fuel consumption.

An electric water pump comprises, as illustrated in FIG. 2, a body E8, a shaft E2 on which an impeller E1, two bearings E4 and a magnet E6 are securely and coaxially mounted. Housed in the body E8 is a winding E5 which is fixed facing the magnet E6.

The bearings are arranged on each side of the magnet E6. The impeller E1 is outside the body E8.

In the case of an electric water pump, the rotational movement is transmitted not by the heat engine but by an electric motor. When the winding has power applied to it, the magnetic field thus generated turns the shaft E2, via the magnet E6.

Sealing between a dry side and a part in contact with the liquid coolant is provided by a static seal assembly E3.

The rolling bearings M5 of a mechanical water pump are replaced in an electric water pump by the two bearings E4, generally made of carbon, which are immersed in the liquid coolant and which are therefore naturally cooled. There is no leakage flow.

Document JP2005-256642 describes a method comprising the following steps: a liquid coolant temperature thw is detected; on the basis of the detected liquid coolant temperature a corresponding basic output Pb is determined using a thw/Pb look-up table; an engine temperature Tm is estimated; a difference (Ts=Tm−Tf) between the engine temperature and the temperature of the liquid coolant is calculated; a corrective factor V is determined using a Ts/V look-up table; this corrective factor V is then finally used to correct the basic output value Pb to be fed into the electric water pump.

Document JP2000-303841 describes a method allowing control of an electric water pump using: a comparison between a temperature of the liquid coolant in a water jacket of the engine and a first threshold; and comparisons between a temperature of the liquid coolant in an engine heating radiator and a second, third and fourth threshold.

These two proposed solutions using temperature sensors which need to be robust because they are used in a hot environment (water temperature of the order of 100° C.), because otherwise there is a risk that the temperature detected will be erroneous. These solutions are therefore expensive.

Now, it would be advantageous to make use of the installations already present on numerous models of combustion engine available at the present time.

Such solutions have already been proposed.

Document US 2003/0113213 describes a method in which either a temperature of the liquid coolant present in the engine is determined and compared against a reference temperature, or a quantity of fuel injected into the engine since start-up is compared against a reference quantity of fuel. These comparisons make it possible to control the circulation of liquid coolant by the electric water pump.

However, using the quantity of fuel injected in order to determine when to activate the electric water pump is not a reliable solution because the quantity of fuel is not directly connected to a temperature of the hottest point in an engine (it being this temperature that determines when the electric water pump needs to be switched on), since the temperature of this point is dependent on a number of parameters including engine efficiency, combustion air mixture, fuel quality, etc.

Document De 102 48 552 describes a method in which the switching-on of the electric water pump is instructed when at least one of the following values exceeds a respective threshold: the temperature of the liquid coolant; the temperature of the admitted air; the heating power; and a length of operation.

Likewise, the electric water pump is switched on if an engine speed exceeds a threshold speed at the same time as the vehicle speed exceeds a threshold speed.

However, one of the disadvantages with this method is that the water pump is switched on after a determined length of operation. That is to say that, regardless of the ambient temperature, the liquid coolant is circulated once the engine has been running for longer than this length of operation, even though under certain conditions it would be more economical for the engine not to be cooled because this engine is still cold.

It is an object of the invention to propose a method for controlling the rate of flow of liquid coolant that uses the equipment already present in most combustion engines.

To this end, the invention proposes a method for controlling the rate of flow of a liquid coolant in a combustion engine comprising a crank case and a water pump, characterized in that an estimate of a material temperature, corresponding to the hottest point of the crank case, is made on the basis of a calculation of stored energy calculated as an integral of a restored power corresponding to a power restored to the liquid coolant if the liquid coolant was set in motion.

One advantage of the method according to the invention is that it provides a more precise estimate of the temperature of the combustion engine and thus makes operation of the water pump more economical.

Other nonlimiting and optional features are:

- the method comprises the steps consisting in determining the restored power on the basis of an engine speed and of an engine power;
- the method comprises the steps consisting in determining a decision regarding the rate of flow of liquid coolant on the basis of the restored power and of an engine status;
- the step consisting in determining a decision regarding the rate of flow of liquid coolant comprises the following substeps: initializing a first threshold energy when the engine status corresponds to a starting of the engine; calculating the stored energy iteratively as long as the stored energy is below the first threshold energy, on the basis of the stored power; and stopping the calculation of stored energy as soon as the stored energy reaches or exceeds the first threshold energy;
- the decision regarding the rate of flow of liquid coolant is such that: the liquid coolant is not circulated as long as the stored energy is below the first threshold energy; and the liquid coolant is circulated as soon as the stored energy reaches or exceeds the first threshold energy.
- the step consisting in determining a decision regarding the rate of flow of liquid coolant further comprises the substep of initializing a second intermediate threshold energy lower than the first threshold energy when the engine status corresponds to a starting of the engine;
- the decision regarding the rate of flow of liquid coolant is such that: the liquid coolant is not circulated as long as the stored energy is below the second intermediate threshold energy; the liquid coolant is circulated as a first flow rate as soon as the stored energy reaches or exceeds the second intermediate threshold energy and as long as it is below the first threshold energy; and the liquid coolant is circulated as a second flow rate higher than the first flow rate as soon as the stored energy reaches or exceeds the first threshold energy;
- the method comprises a first safety mode that consists in circulating the liquid coolant at least at a predetermined third flow rate as soon as a coolant temperature corresponding to the temperature of the liquid coolant in the engine reaches or exceeds a threshold temperature;
- the method further comprises a second safety mode that consists in circulating the liquid coolant at least at a predetermined fourth flow rate after a predetermined time has elapsed since the engine was started;
- the first threshold energy and, where appropriate, the second intermediate threshold energy is/are initialized as a function of a temperature of the liquid coolant in the engine at the time of starting of the engine; and
- the estimate of material temperature on the basis of the stored energy is made using a stored energy/material temperature look-up table; and in that this stored energy/material temperature table is obtained during a learning phase at a determined rotational speed and when the stored power is stable.

The invention also proposes a system for controlling the rate of flow of liquid coolant implementing the method as claimed in any one of the preceding claims, characterized in that the system comprises:

- a temperature crank case sensor;
- a determining unit for determining the stored power on the basis of an engine speed and of an engine torque; and
- a decision unit that determines the rate of flow of liquid coolant as a function of the stored energy.

Other features, objects and advantages of the present invention will become apparent from reading the detailed description which will follow, with reference to the accompanying drawings which have been given by way of nonlimiting examples and in which.

Figure 1:
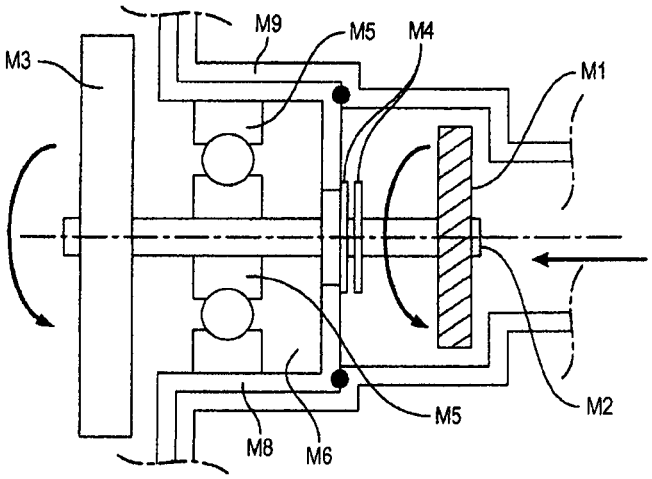
FIG. 1 is a schematic depiction of a mechanical water pump.
Figure 2:
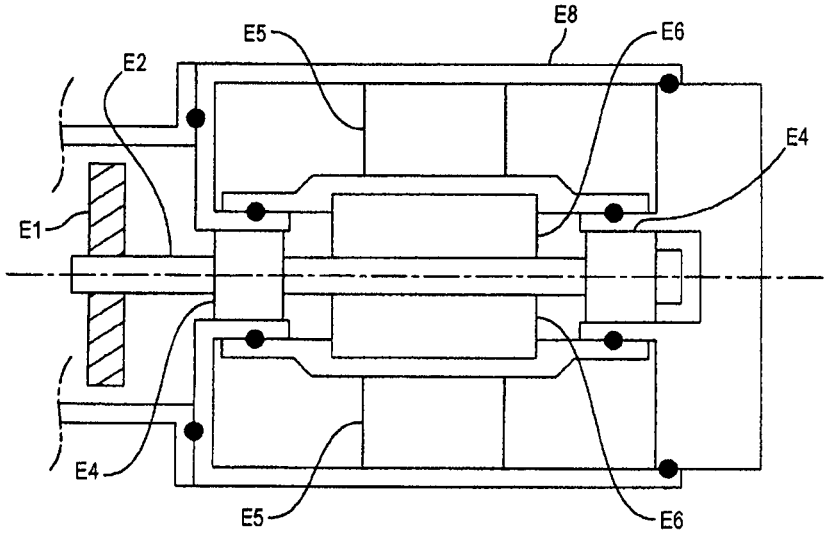
FIG. 2 is a schematic depiction of an electric water pump.
Figure 3:
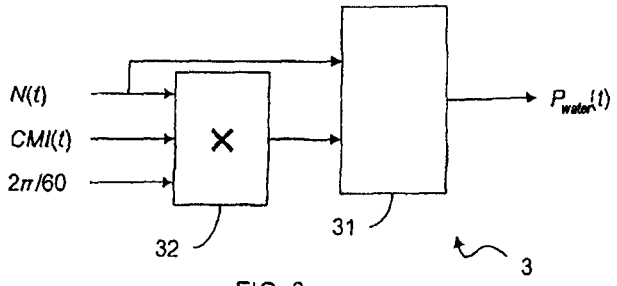
FIG. 3 is a schematic depiction of a determining unit for determining the stored power.

As has already been stated, the warmer the material of which an engine is made, the lower the viscosity of the engine oil. This leads to a reduction in friction and therefore to a reduction in fuel consumption.

However, the engine material must not exceed a critical temperature. Beyond this critical temperature, the engine is no longer reliable and a great deal of engine damage may occur.

However, the temperature of the engine material (hereinafter termed the material temperature) may, depending on ambient temperature, be below the critical temperature prior to start-up.

During a period ranging from start-up as far as the moment when the material temperature exceeds the critical temperature, it is therefore advantageous for the engine not to be cooled.

This is why, in certain situations, it is beneficial to delay the circulation of a liquid coolant in an engine cooling circuit fitted with an electric water pump.

In order to determine the moment at which the liquid coolant needs to be circulated, it is necessary to determine the material temperature of the engine. The engine material temperature taken into consideration needs to be a temperature $T_{max}$, of a point in the engine which is the hottest point P1.

For preference, this point P1 is situated at an exhaust/exhaust valve bridge.

However, for cost and reliability reasons, it is disadvantageous to attempt to acquire this temperature $T_{max}$. This temperature $T_{max}$, is therefore, according to the invention, determined from a quantity of energy stored in the engine.

When the electric water pump is operating, this quantity of stored energy is restored to the liquid coolant. If the liquid coolant is not being circulated, this quantity of energy is then transmitted to the material of the engine, causing it to heat up.

This quantity of stored energy is therefore a faithful representation of the material temperature taking the material temperature at the time of start up into consideration. Further, an estimate of this temperature is made using a stored energy/material temperature look-up table.

This quantity of stored energy is expressed by the relationship:

$$E \square \int_{t_0}^{t_1} P_{water}(N(t),\ PME(t)) \cdot dt;$$

where $t_0$ is the moment the cycle starts and $t_1$ is the moment at which the stored energy is considered; $P_{water}$ is a power restored to the liquid coolant when this coolant is circulated and if not is restored to the material of the engine; N(t) is an engine speed at the moment t; and PME(t) is an effective engine power at the moment t.

This quantity of energy is determined by a determining unit that determines the stored energy and that works as follows.

The power $P_{water}$ is determined from a heat energy/water look-up table expressed in the form of a two-input table (the two inputs being engine speed and effective engine power).

This table is predetermined by testing in which the power $P_{water}$ is measured for each pair (N(t); PME(t)) of the table.

The energy E is then compared against a threshold energy $E_{thresh}$ which is dependent on the material temperature at start-up which is assumed to be equal to the temperature of the liquid coolant in the engine.

This threshold energy $E_{thresh}$ is determined during engine testing at a steady speed at a constant speed and engine power setting. With a zero rate of flow of liquid coolant, acquisition of data from the time the engine started to operate until the critical temperature is reached allows the threshold energy $E_{thresh}$ to be determined by calculating the integral (which gives E and which is simplified because of the steady speed).

A decision unit determines a mode of operation of the water pump.

As long as the energy E is below the threshold energy $E_{thresh}$, the electric water pump is not switched on.

Thus, the electric water pump has at least two modes of operation.

In the first mode of operation, when $E<E_{thresh}$, the water pump is not switched on, and liquid coolant is therefore not circulated.

In the second mode of operation corresponding to $E>E_{thresh}$, the pump is switched on and its rotational speed is connected to the conditions of use of the engine.

In another embodiment of the invention, an intermediate mode of operation is added as is a second threshold energy $E_{int}$ lower than the threshold energy $E_{thresh}$. The pump thus has three modes of operation.

In an alternative form, the second threshold is an intermediate threshold energy corresponding to a critical temperature of use of one part of the cooling circuit.

In another alternative form, the second threshold is added in order to allow the circulation of the liquid coolant brought about by the water pump in a way not connected with the conditions of use of the engine. For example, that is desirable in order to lessen the impact of a delay, due to non-circulation of liquid coolant, of coolant temperature data delivered by a sensor.

The intermediate mode of operation corresponds to a rate of flow of liquid coolant lower than or equal to that of the second mode of operation.

As an alternative form to the first and second embodiments, a time threshold, corresponding to a length of use beyond which the liquid coolant is circulated, is added. This is determined by a liquid coolant temperature monitoring unit.

As a further alternative form of the first and second embodiments, a liquid coolant temperature threshold may be added. If the temperature of the liquid coolant contained in the engine but not circulating exceeds this threshold, the liquid coolant is circulated.

As a further alternative form, the time threshold and the threshold on temperature may both be added to the first and/or second embodiments.

Particular embodiments of each of the units, given by way of example, are described hereinafter with reference to FIGS. 3 to 6.

The stored power $P_{water}(t)$ is calculated by the determining unit 3 that determines the stored energy from a measurement of engine speed N(t) and a measurement of engine torque CMI(t). A multiplier 32 multiplies the values of these measurements and at output gives the effective engine power PME(t), according to the formula:

$$PME(t) = \frac{2 \cdot \pi}{60} \cdot CMI(t) \cdot N(t).$$

The effective engine power PME(t) and the engine speed N(t) are then sent as input to the heat energy/water look-up table 31 which gives as output the stored power.

Figure 4:
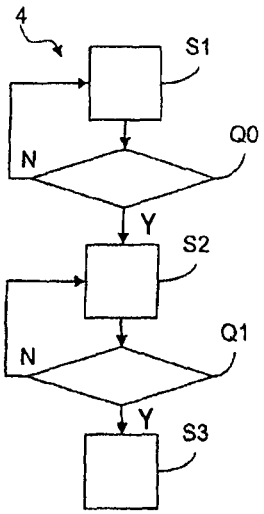
FIG. 4 is a flow diagram depicting a first embodiment of a decision unit according to the invention.

FIG. 4 is a flow diagram illustrating the method for controlling the rate of flow of liquid coolant according to the first embodiment with the decision unit 4 having two modes of operation.

In the first step S1, the values of stored power and of threshold energy are initialized. The initial stored power is zero and the threshold energy depends on the initial temperature of the liquid coolant, that is to say at the time of start-up. This threshold energy is determined from a table with one input variable (the initial temperature of the liquid coolant).

As long as the engine is not started, the method remains at the first step. If the engine is started, a calculation module calculates the stored energy E(t) in step S2. This calculation is reiterated at regular intervals dt. Thus, the stored energy at the moment t is:

$$E(t)=E(t-dt)+P_{water}(t)\cdot dt.$$

Prior to each reiteration of the calculation, a comparison module compares the value of the stored energy against the threshold energy determined in step S1(Q1).

If the stored energy is lower than the threshold energy then the calculation is reiterated.

If the stored energy is higher than the threshold energy then the calculation is not reiterated and the water pump is switched on in step S3.

Figure 5:
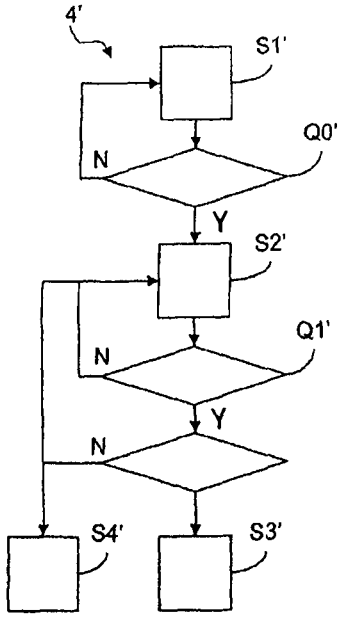
FIG. 5 is a flow diagram depicting a second embodiment of a decision unit according to the invention.

FIG. 5 is a flow diagram illustrating the second embodiment of the method with the decision unit 4' having three modes of operation.

In a first step S1', the stored power $P_{water}$ the first threshold energy $E_{thresh}$ and the second intermediate threshold energy $E_{int}$ are initialized. As long as the engine is not started, the method remains on the first step S1'.

Following start-up, the calculation module calculates the stored energy in a second step S2' identical to step S2.

An intermediate level comparison module compares the stored energy E(t) against the second intermediate threshold energy $E_{int}$(Q2').

If the stored energy E(t) is lower than the second intermediate threshold energy $E_{int}$ the calculation is reiterated in step S2'. If not, a comparison module compares the stored energy E(t) against the first threshold energy $E_{thresh}$(Q1').

If the stored energy E(t) is lower than the first threshold energy $E_{thresh}$ then the intermediate mode of operation is set in action in step S4'.

If the stored energy E(t) is higher than the first threshold energy $E_{thresh}$ then the second intermediate mode of operation is set in action and the calculation of stored energy E(t) is stopped in step S3'.

Finally, convection losses in the liquid coolant play a part in increasing the temperature of the liquid coolant and, according to how the circuit is arranged, in creating a thermosiphon effect. It is therefore possible to use a threshold on the coolant temperature $T_{thresh}$ in order to take this increase in liquid coolant temperature into consideration.

Another threshold on the time elapsed since start-up is also possible.

The thresholds on the coolant temperature and on the time elapsed since start-up are as an alternative to the safety thresholds, that is to say that irrespective of the decision taken by the decision unit 4, 4', if the liquid coolant temperature threshold and/or the threshold regarding the time elapsed since start-up is/have been reached and/or exceeded then liquid coolant is circulated.

Figure 6:
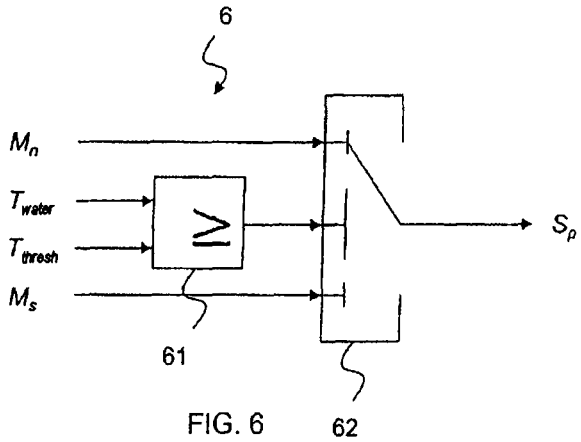
FIG. 6 is a schematic depiction of a unit for monitoring the temperature of the liquid coolant.

FIG. 6 is a diagram illustrating the operation of the unit 6 that monitors the temperature of the liquid coolant to make it possible to take the increase in coolant temperature as a result of convection losses into consideration. This module comprises a comparator 61 that compares the coolant temperature $T_{water}$ against the threshold $T_{thresh}$. The coolant temperature is measured by a temperature sensor that is conventional for this kind of use. The output from the comparator is connected to a switch 62 that allows a switchover from a nominal control mode $M_n$ to a safety mode $M_s$ yielding, at the output of the monitoring unit 6, a safety set point $S_p$, that determines the speed at which the pump is to operate in safety mode.

The nominal control mode corresponds to the mode of operation determined by the decision unit 4, 4'. The safety mode corresponds to a predetermined default mode of operation.

For example, for the safety mode, the default mode of operation associated therewith corresponds to a threshold rotational speed $W_{thresh}$ for example 85% of the maximum possible rate of flow. The condition governing switchover to the safety mode is $T_{water} \geq T_{thresh}$.

Figure 7:
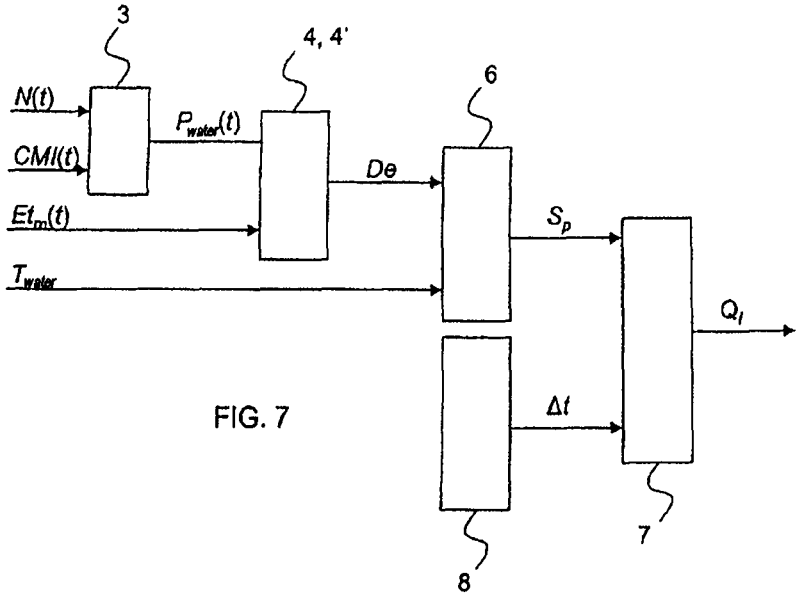
FIG. 7 is a schematic depiction of one exemplary embodiment of the method according to the invention.

An illustrative and nonlimiting exemplary embodiment that implements the three abovementioned units is described hereinafter with reference to FIG. 7.

In this embodiment, the input data are:

the coolant temperature $T_{water}$;

the rotational engine speed N(t);

the engine torque CM/(t); and the running/stationary engine status $Et_m$.

The output data item is a set point for the control of the rate of flow of liquid coolant, here expressed in the form of pulse width modulation (PWM). What that means is that the time spent in the high state, during one period of the square wave signal generated, determines the rate of flow of liquid coolant.

The determining unit 3 that determines the stored energy receives as input the rotational engine speed N(t) and the engine torque CMI (t) and at output returns the power $P_{water}$ (t).

The decision unit 4, 4' receives as input the power $P_{water}$ (t) and the status of the engine $Et_m$ (started or not) and at output returns a decision De regarding the rate of flow of liquid coolant to set up in the engine.

The liquid coolant temperature monitoring unit 6 receives as input the measurement of the coolant temperature. It returns at output a decision regarding the rate of flow of liquid coolant, which rate of flow is either the one determined by the decision unit 4, 4' or a safety rate of flow corresponding to the safety mode.

The outputs from the units 4 (or 4') and 6 are sent to the input of a flow rate determining unit 7 which determines the rate of flow Q1 of liquid coolant to be set in place according to the information and according to the engine speed N(t).

As an alternative form, a monitoring unit 8 that monitors the time elapsed since start-up may be added, this comprising an integrator with respect to time and returning the time elapsed since start-up Δt. Its output is sent to the flow rate determining unit 7.

The method according to the invention is not limited to a use for controlling the rate of flow of liquid coolant in an engine fitted with an electric water pump; it may advantageously be used for determining a threshold for activating a disengageable water pump that is electromagnetic, pneumatic, employs a friction roller or is associated with a valve.

One advantage of this method is that it does not have recourse to sensors other than those that already exist in most engines fitted with a mechanical water pump.

Another advantage of this method is that the information necessary for implementing it are available on an engine (torque, speed, temperature) management system.

The invention claimed is:

1. A method for controlling a rate of flow of a liquid coolant in a combustion engine including a crank case and a water pump, the method comprising:

estimating a temperature of a crank case material at a hottest point of the crank case, on the basis of a calculation of stored energy calculated as an integral of a stored power taken from the time the engine was started.

2. The method as claimed in claim 1, further comprising:

determining the stored power on the basis of an engine speed and of an engine power.

3. The method as claimed in claim 1, further comprising:

determining a decision regarding the rate of flow of liquid coolant on the basis of the stored power and of an engine status.

4. The method as claimed in claim 3, wherein the determining a decision regarding the rate of flow of liquid coolant comprises:

initializing a first threshold energy when the engine status corresponds to a starting of the engine;

calculating the stored energy iteratively as long as the stored energy is below the first threshold energy, on the basis of the stored power; and stopping the calculation of the stored energy as soon as the stored energy reaches or exceeds the first threshold energy.

5. The method as claimed in claim 4, wherein the decision regarding the rate of flow of liquid coolant is such that:

the liquid coolant is not circulated as long as the stored energy is below the first threshold energy; and the liquid coolant is circulated as soon as the stored energy reaches or exceeds the first threshold energy.

6. The method as claimed in claim 4, wherein the determining a decision regarding the rate of flow of liquid coolant further comprises:

initializing a second intermediate threshold energy lower than the first threshold energy when the engine status corresponds to a starting of the engine.

7. The method as claimed in claim 6, wherein the decision regarding the rate of flow of liquid coolant is such that:

the liquid coolant is not circulated as long as the stored energy is below the second intermediate threshold energy;

the liquid coolant is circulated as a first flow rate as soon as the stored energy reaches or exceeds the second intermediate threshold energy and as long as it is below the first threshold energy; and the liquid coolant is circulated as a second flow rate higher than the first flow rate as soon as the stored energy reaches or exceeds the first threshold energy.

8. The method as claimed in claim 3, further comprising:

executing a first safety mode that circulates the liquid coolant at least at a predetermined flow rate as soon as a coolant temperature corresponding to the temperature of the liquid coolant in the engine reaches or exceeds a threshold temperature.

9. The method as claimed in claim 3, further comprising:

executing a second safety mode that circulates the liquid coolant at least at a predetermined flow rate after a predetermined time has elapsed since the engine was started.

10. The method as claimed in claim 6, wherein the first threshold energy and, where appropriate, the second intermediate threshold energy is/are initialized as a function of a temperature of the liquid coolant in the engine at a time of starting of the engine.

11. The method as claimed in claim 1, wherein the estimate of the crank case material temperature on the basis of the stored energy is made using a stored energy/material temperature look-up table; and the stored energy/material temperature look-up table is obtained during a learning phase at a determined rotational speed and when the stored power is stable.

12. A system for controlling a rate of flow of a liquid coolant implementing the method as claimed in claim 1, the system comprising:

a temperature crank case sensor;

a determining unit that determines the stored power on the basis of an engine speed and of an engine torque; and a decision unit that determines the rate of flow of liquid coolant as a function of the stored energy.

13. A motor vehicle comprising the system as claimed in claim 12.

14. A method for controlling a rate of flow of a liquid coolant in a combustion engine including a crank case and a water pump, the method comprising:

a first step including initializing a threshold energy value based on a temperature of the liquid coolant, determining whether the engine is started, if the engine is not started, then repeating the first step, and if the engine is started, then continuing to a second step;

the second step proceeding at one or more regular time intervals and including for each of the one or more time intervals determining a stored power value that represents an amount of power stored in the crank case at a time during the time interval, calculating a stored energy value by integrating with respect to time the stored power value and all stored power values determined for preceding time intervals after the engine was started, comparing the stored energy value to the threshold energy value, if the stored energy value is lower than the threshold energy value, then repeating the second step for a subsequent time interval, and if the stored energy value is higher than or equal to the threshold energy value, then switching on the water pump.

15. The method as claimed in claim 14, wherein the determining a stored power value includes:

measuring an engine speed;

measuring an engine torque; and multiplying the engine speed and the engine torque to calculate an effective engine power.

16. The method as claimed in claim 15, wherein the determining a stored power value further includes looking-up the stored power value in a look-up table based on the engine speed and the effective engine power.

17. The method as claimed in claim 16, wherein the look-up table includes contents obtained during a learning phase at a determined rotational speed and when the stored power is stable.

18. A method for controlling a rate of flow of a liquid coolant in a combustion engine including a crank case and a water pump, the method comprising:

a first step including initializing a first threshold energy value, initializing a second intermediate threshold energy value, determining whether the engine is started, if the engine is not started, then repeating the first step, and if the engine is started, then continuing to a second step;

the second step proceeding at regular time intervals and including for each of the time intervals determining a stored power value that represents an amount of power stored in the crank case at a time during the time interval, calculating a stored energy value by integrating with respect to time the stored power value and all stored power values determined for preceding time intervals after the engine was started, comparing the stored energy value to the second intermediate threshold energy value, if the stored energy value is lower than the second intermediate threshold energy value, then repeating the second step, if the stored energy value is greater than or equal to the second intermediate threshold energy value, then comparing the stored energy value to the first threshold energy value, if the stored energy value is lower than the first threshold energy value, then setting in action a first intermediate mode of operation, and if the stored energy value is greater than or equal to the first threshold energy level, then setting in action a second intermediate mode of operation and stopping the calculating the stored energy value.

19. The method as claimed in claim 18, wherein the determining a stored power value includes:

measuring an engine speed;

measuring an engine torque;

multiplying the engine speed and the engine torque to calculate an effective engine power; and looking-up the stored power value in a look-up table based on the engine speed and the effective engine power, wherein the look-up table includes contents obtained during a learning phase at a determined rotational speed and when the stored power is stable.

20. The method as claimed in claim 18, wherein the first threshold energy value is initialized as a first function of a temperature of the liquid coolant in the engine at a time of starting of the engine and the second intermediate threshold energy value is initialized as a second function of the temperature of the liquid coolant in the engine at the time of starting of the engine.

* * * * *